United States Patent [19]

Hermanns

[11] 4,136,907

[45] Jan. 30, 1979

[54] BARBERCHAIR

[76] Inventor: Margret Hermanns, Gotzweg 15, D-4050 Monchengladbach 2, Fed. Rep. of Germany

[21] Appl. No.: 771,756

[22] Filed: Feb. 24, 1977

[30] Foreign Application Priority Data

Feb. 24, 1976 [DE] Fed. Rep. of Germany ..... 2607862

[51] Int. Cl.[2] ..... A47D 15/00; A47C 7/50; A47B 83/00

[52] U.S. Cl. ..... 297/182; 297/191; 297/217; 297/423; 312/235 R

[58] Field of Search ..... 297/191, 182, 188, 192, 297/217, 71, 423; 312/235 R, 223

[56] References Cited

U.S. PATENT DOCUMENTS

| | | | |
|---|---|---|---|
| 837,570 | 12/1906 | Jackson | 297/182 |
| 857,323 | 6/1907 | Breakenridge | 297/221 |
| 1,403,543 | 1/1922 | Daniel | 312/235 R |
| 1,533,219 | 4/1925 | Sugerman | 312/235 R |
| 2,020,207 | 11/1935 | Platter | 297/438 |
| 2,634,801 | 4/1953 | Strock | 312/235 R |
| 2,679,288 | 5/1954 | Larger | 297/182 |
| 2,734,559 | 2/1956 | Vaughn | 312/235 R |
| 2,759,529 | 8/1956 | Hagadorn | 312/235 R |
| 3,289,679 | 12/1966 | Zellerman | 34/3 X |
| 3,994,528 | 11/1976 | Humphrey | 297/182 |

FOREIGN PATENT DOCUMENTS

| | | | |
|---|---|---|---|
| 486535 | 1/1918 | France | 297/182 |

*Primary Examiner*—James T. McCall
*Attorney, Agent, or Firm*—Donald A. Kettlestrings

[57] ABSTRACT

A barberchair having collecting devices connected to and in operative relationship with the backwall and sidewalls of the barberchair for collecting falling hair from a person seated in the chair.

36 Claims, 9 Drawing Figures

Figure 1:
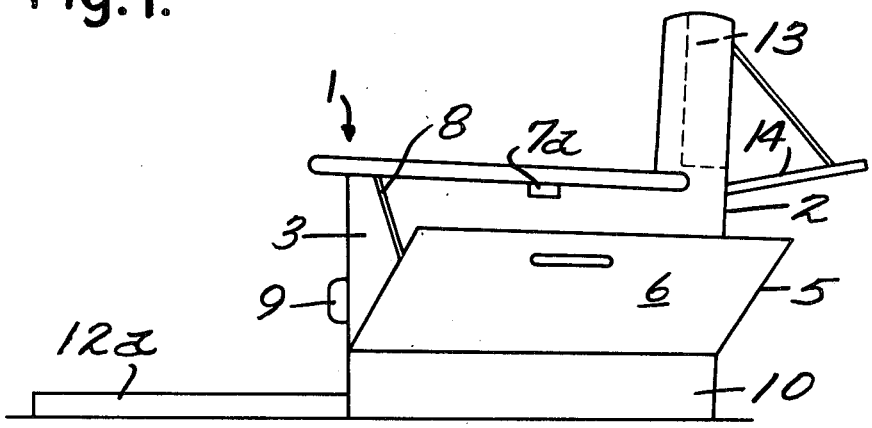

Fig. 6
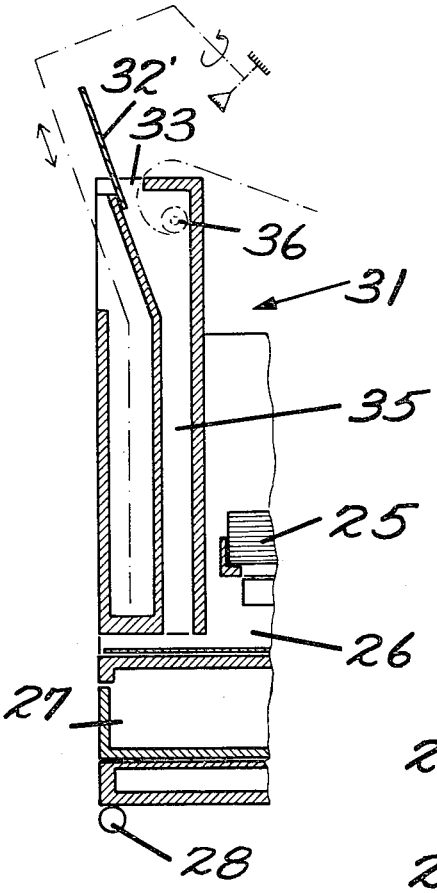
Fig. 9
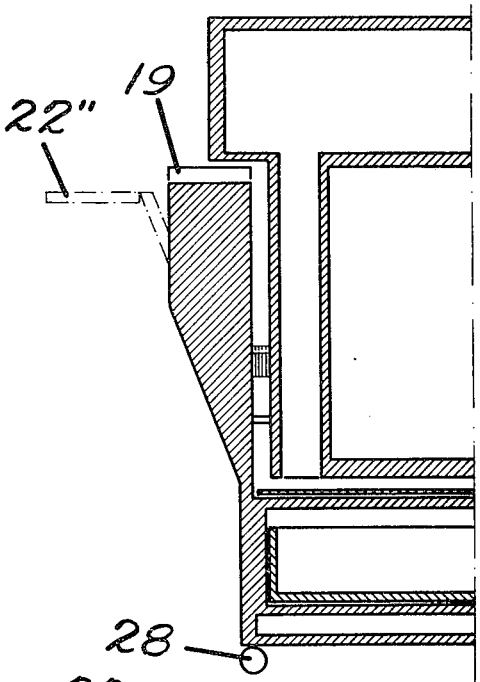
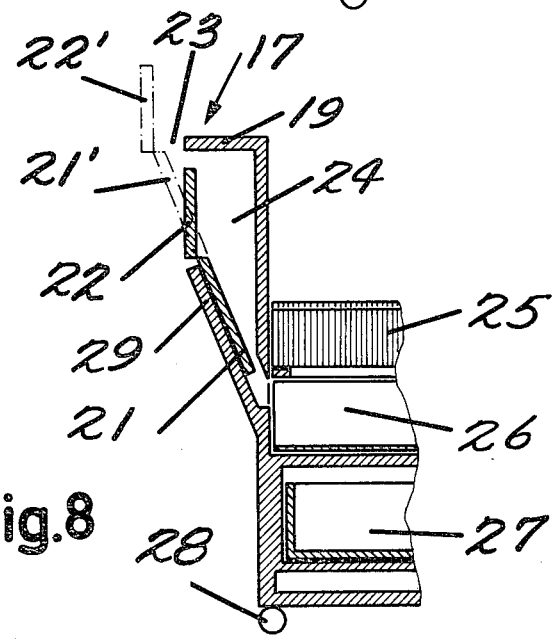
Fig.8

BARBERCHAIR

This invention concerns a barberchair.

When a client enters a barbershop or beauty salon, he or she will be seated in a barberchair for service, and the care for hair or beard can then commence. The cut hair falls to the ground. This is considered to be a nuisance even with tiled or other smooth surface floors, so that it becomes neccessary to sweep the hair away in frequent regular intervals. It is especially irritating though, if the cut hair falls on a floor which is equipped with rugs or carpeting, since under these circumstances the sweeping-up of the hair from surfaces like these can only be accomplished with great difficulty. On the other hand, though, it is found to be disturbing, if a vacuum cleaner is being used, often in short intervals.

To alleviate this disadvantage, the invention is based on the proposition, to create a barber- or hairdresser-chair, which would avoid having the cut hair fall to the ground.

As per this invention, this proposition is accomplished by the fact that flaps are being installed on the back- and sidewalls of the chair, which are swivel-mounted at their lower end to the chair and can be arrested in a diagonal position. Beyond this there is below the chair a collecting area conceived, to receive the cut hair, which will slide down the diagonally positioned flaps.

By this type of invention it is accomplished, that the flaps function as collecting slides for the falling hair, whereby the hair is directed into a collecting area. Thereby it is avoided, that the hair falls loosely to the ground, and a highest degree of cleanliness is achieved during the service to the customer.

In order to accomplish a collection of the hair that falls to the front, a further feature of the invention can be projected, which would enclose the foot rest area to the sides and toward the front of a person sitting in the chair. The hair falling forward therefore would fall into the foot rest area and not onto the surrounding floor area.

A further feature of the invention could be, that in the area of the feet of a person sitting in the chair, the foot-rest can be construed in such a way, that it can be taken off. Thereby the possibility exists, that the foot rest is construed as a grill, so that the forward falling hair can pass through the grill, for instance into a collecting container. But there is also the possibility, to construe the replaceable foot rest as a plate. Then, if there are hair lying on the plate, it would be possible by lifting the plate slightly into a diagonal position, to achieve, that the hair will slide into a container or area placed underneath it.

In a further development of the invention it can be conceived, that a removable cover plate, similar to the foot rest, could be installed totally surrounding the chair. Thereby it is accomplished, that the hair, falling beyond the flaps attached to the chair, will be collected on this plate and therefore will not fall to the ground.

A further feature of the invention preconceives, that the side flaps and the flap on the back of the chair are connected via a connecting element made of a flexible material.

Finally it can be a feature of the invention, that the back of the chair above the projected flap will be provided with a cabinet-like device, which can hold the tools of the trade, an electrical plug, and other items of this nature. It can be useful to equip this cabinet with a swivel-flap, that can be locked or closed. If this swing-flap is swivel-mounted on its lower side, and a device is attached to it to arrest the flap at a horizontal position, then the swing-flap can be used at the same time as tray for the tools while serving the customer. The hair, falling into the collection area at the lower part of the chair, can be directed into a specially designed, removable collecting bowl.

A further feature of a hairdresser-chair as conceived by this invention would be to equip the back of the chair at the top rim with a swivel-mounted flap, which could be arrested at a 90° angle to the back rest, to form a plane surface. This so arrested flap could hold combs, scissors, razors and foam brushes, or other similar items. The back rest itself could serve underneath the flap, if formed as a hollow space, as a further storage area for fans, haircutters, and other tools of this kind.

In a further development of the invention it could be conceived, that the hollow space in the back rest of the chair is equipped with a pit-type slide, which would be connected to the collection container. Thereby the trash and remains, which occurs while serving the customer, can be disposed over this slide in the same operating manner as a trash-chute.

As another feature of the invention it could be provided, that above the outer rim of the hollow space in the back rest a swivel-mounted flap is positioned, which can be swung between a vertical and a horizontal position, whereby in one position the flap would cover the upper opening of the hollow space in the back rest, while in the other position it would protrude beyond the hollow container in a table-like manner.

As a further feature of the invention it can be provided, that there will be collecting devices installed to the arm rests. With this measure an easy method is provided to convert already existing barberchair as per this invention, by attaching the respective collecting devices to the sides of the arm rest. This type of collecting device could for instance also be construed as an extension device, which can be pulled out of the side-flaps. It could be useful to equip the collecting devices with a bowl-like collecting container which would be attached to the bottom end.

There is also a possibility to develop the previously mentioned collecting device as a swivel-mounted flap, attached to the upper end of the outer wall of the collection bowl. This flap can then be swivelmounted in such a way that it can be brought into a vertical as well as horizontal position, whereby one flap position would generally cover the collecting container and the other would extend in a table-like manner beyond the outer rim of the collection container.

A further feature of the invention could be, that beneath the seat of the chair a suction device functioning like a vacuum cleaner is installed and from which a suction hose, connected to the device, leads to the upper rim of the back rest, extending far enough beyond to allow the sucking-off of hair, etc., from the head and neck area.

Furthermore, it can be provided for in this invention, that under the seat a cable coil device is mounted for the extension cords of the electrical appliances, such as the hair cutter, the fan, or similar items.

Finally the invention can provide for a coiling-up device in the upper area of the back rest, which would roll-up the cape.

Figure 2:
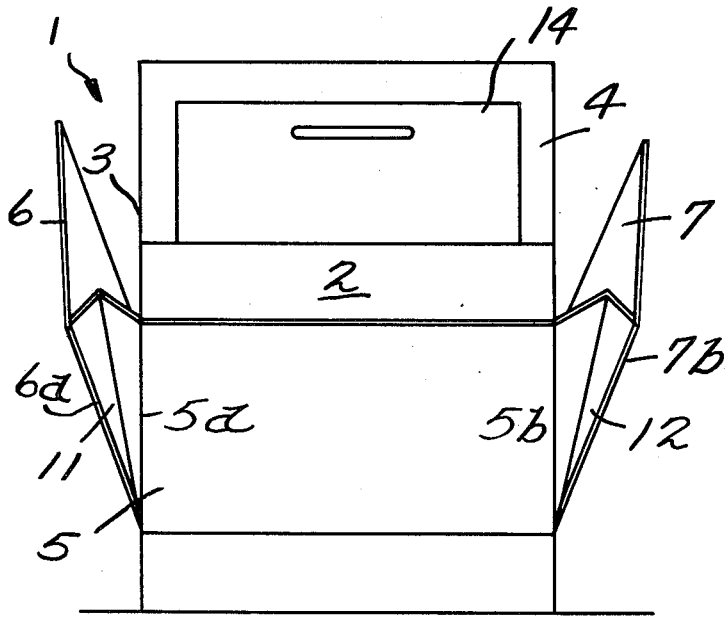

In the drawing a production sample of the barberchair as per invention is shown schematically. The following is shown:

FIG. 1 — a side view of the barberchair as conceived by the invention;

FIG. 2 — a view from the back of the barberchair as conceived by the invention

Figure 3:
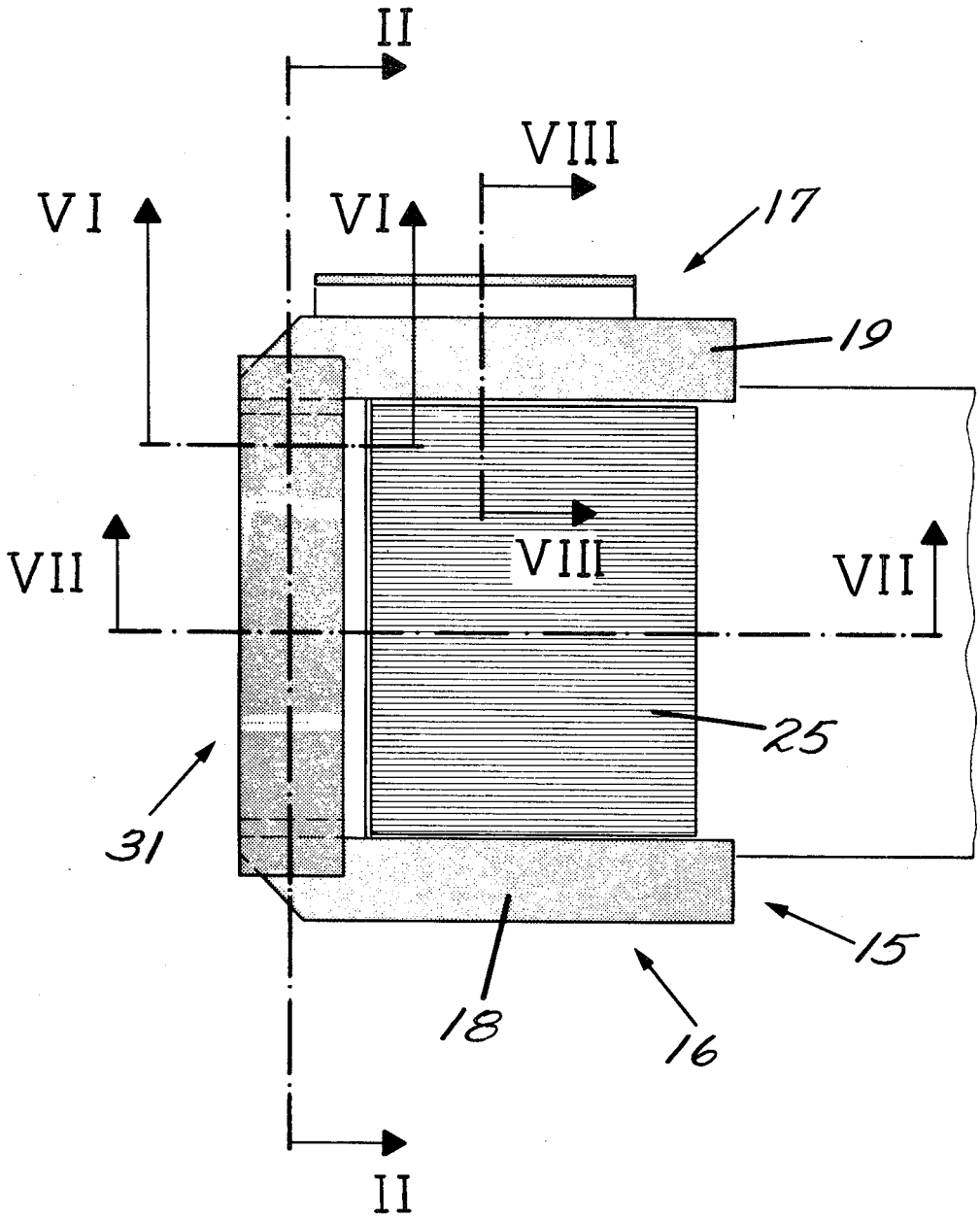
Figure 4:
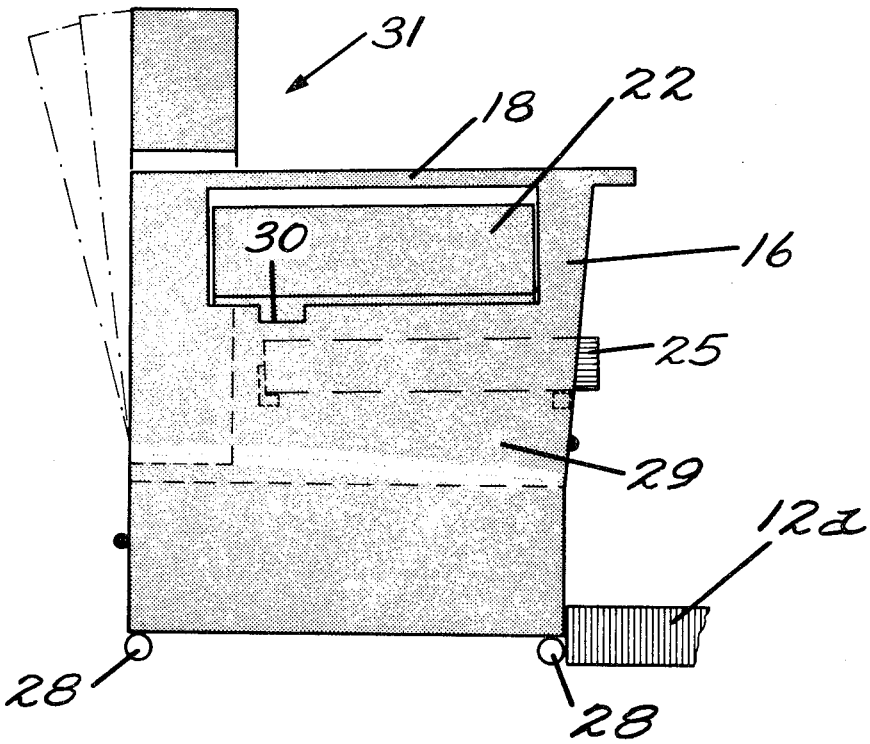

FIG. 3 — a top view of a further exposition example of barber chair as per invention;

FIG. 4 — a side view of the barber chair as in FIG. 3

Figure 5:
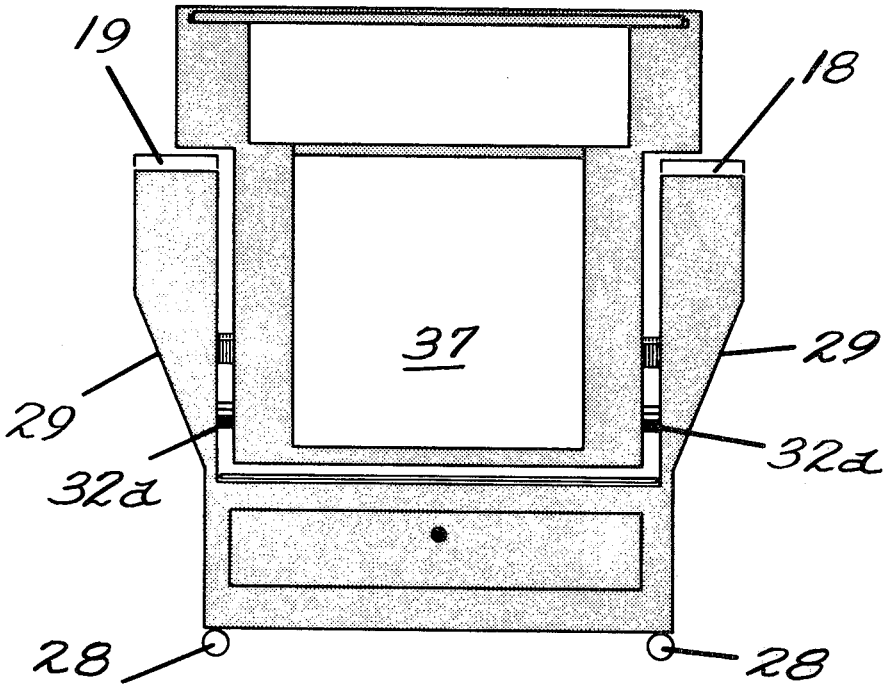

FIG. 5 — a back view of the barber chair as in FIG. 3

FIG. 6 — a cross section along the line VI — VI as shown in FIG. 3

Figure 7:
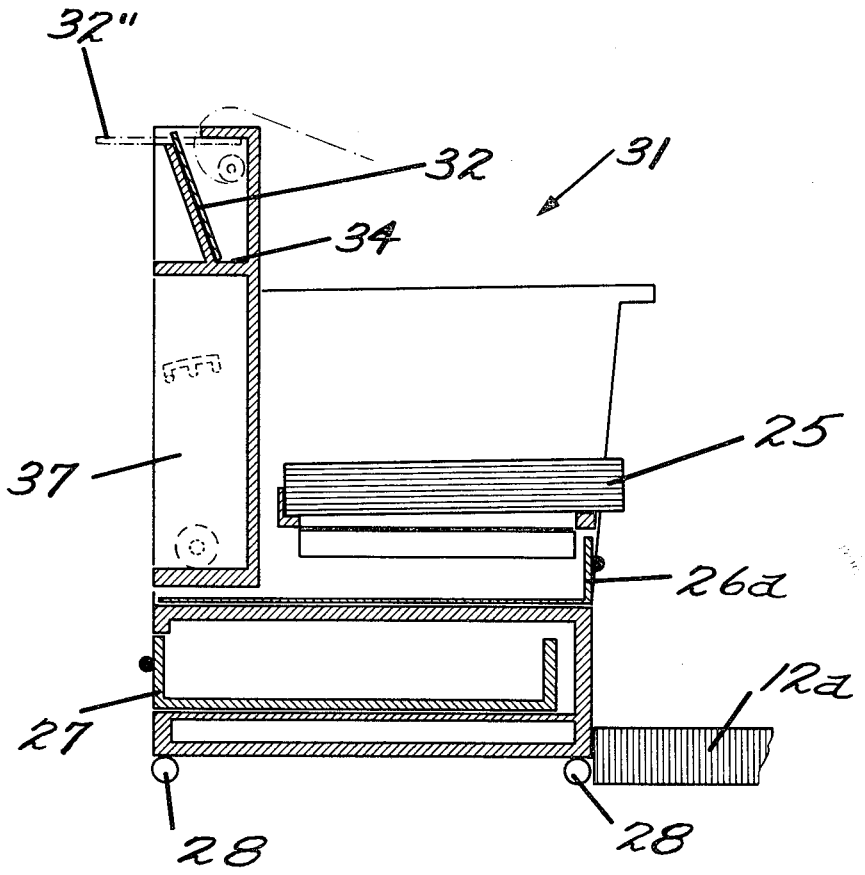

FIG. 7 — a cross section along the line VII — VII as in FIG. 3

FIG. 8 — a cross section along the line VIII — VIII as shown in FIG. 3

FIG. 9 — a cross section along the line IX — IX as shown in FIG. 3

On a barberchair called in its totality 1, there are the flaps 5, 6, and 7 attached to the back side 2, and the two side walls 3 and 4 of the chair. These flaps consist of plate-shaped wood or plastic. The attachment is done in such a way, that it is swivel-mounted at the bottom with a hinge. The flaps are arrested in the closed position by magnets (only one magnet, 7*a*, is shown in the drawing), and in their open position by diagonally attached swing butresses 8. The diagonal position of the flaps 5, 6, and 7 are such, that the inner sides form slides, which guide hair and other similar items into the area below the seat of the chair 9, where a collecting bowl 10, which can be removed, is placed. The edges pointing toward each other, 5*a*, respectively 6*a* and 5*b*, respectively 7*b*, of the flaps are connected with each other by way of connecting elements 11 and 12, made of a flexible material. This prevents, that hair could fall into the area between the edges 5*a* and 6*a*, respectively 5*b* and 7*b*. Furthermore, in the foot area of a person sitting in the chair, there is a removable foot rest 12*a* attached, which could for instance be formed as a plate or as a grill. To the side of this foot rest and toward the front enclosed borders are envisioned. There is also the possibility to attach a cover, corresponding to the removable foot rest, which would surround the barberchair 1. Furthermore, a provision is made in the back rest of the chair 2, to provide for a cabinet-type space 13 above the flap 5, which can serve to receive tools, and in which for instance an electrical outlet for the use of electrical appliances could be installed. The cabinet-type space could be closed-off by a swivel-mounted flap 14, which can be arrested in a somewhat horizontal position, and can thereby serve at the same time as a place of deposit. During the service to a customer, therefore, the falling hair falls onto the flaps, which form through their diagonal position in an extended state a slide and from there into a collecting bowl, invisible to the customer, placed underneath the chair 1. Hair, that falls forward, falls either through the grill-type foot rest or onto the footrest, formed as a plate. Since this plate can be removed, it will only take a quick motion, to lift it up, and by positioning it diagonally, to dispose of the hair on it into an enclosed container below.

For the exposition sample shown in FIGS. 3 to 9, the barberchair, as per invention, is labeled in its totality as 15. The barberchair has in its side walls 16 and 17, under the horizontally positioned arm rests 18 and 19, instead of the flaps, as proposed in the exposition model in FIGS. 1 and 2, pull-out plates 21, which have on their top rim flaps 22, which are attached via hinges. The plates 21 can be pulled out of the position shown in FIG. 8, up into the position 21', which is marked by the dotted line, and can be arrested in this position. Then, the flap 22, as shown in FIG. 9 can be set into the position 22''. Falling hair will slide down through the slot 23, formed between the armrest and the plate 21', and proceeds through the area 24 into a area 26, located under the seat cushion 25. Below this, area a drawer is located 27, as recepticle for tools or similar items. The chair stands on rollers 28. The plates 21 are guided by guard plates 29. In the guard plates 29 are on the upper rim cut-out areas 30, which serve the purpose to facilitate the extension of the plates 21. In the front a foot rest 12*a* can be adjacent.

The barberchair has furthermore a back rest, which is labeled in its entirety 31, whose degree of incline can be adjusted, as is shown diagrammatic in FIG. 4. The back rest 31 is mounted on horizontal pivots 32, to allow for a pendular motion. The back rest 31 has on its upper side an extractable plate (FIG. 7). The plate 32 is shown in its extracted form in FIG. 6. It is also possible to bring the plate 32 into a position 32' which is diagrammed with a dotted line in FIG. 7. Falling hair is directed from plate 32' through an opening 33 onto a horizontal plate 34. Within the horizontal plate 34 there is at least one chute envisioned to the side 35, which ends in the space 26 underneath the seat 25. Falling hair can therefore slide into this space. Furthermore, there is a rolling device attached into the back rest 31, which is labeled 36, which should serve to roll-up a cape, which serves to service the customer. Furthermore there is a space 37 envisioned in the back rest 31, which serves to store tools and other items. The drawer 27 could for instance also hold a vacuum cleaner. Furthermore there could be provisions made for extendable lamps on the side of the back rest, which would be construed in such a fashion, that they would be turnable in a 180° angle. The form can be such, that on one side of each lamp there would be a light source for illumination purposes, and on the opposite sides there would be infra-red lights, to aid in the drying of the hair.

I claim:

1. A chair for use when cutting hair, comprising:

a seat member;

a back rest in operative relationship with said seat member for enabling a person seated on said seat member to lean back against said back rest;

means in operative relationship with said seat member and said back rest for supporting said seat member and said back rest and defining a first internal area or cavity;

side wall members positioned adjacent to said seat member and each of said side wall members defining an internal cavity or area in fluid communication with said first cavity; and plate means in movable operative relationship with said side wall members and in fluid communication with said side wall member cavities for receiving falling hair from the person seated in the chair and for enabling said hair to be directed to said first cavity.

2. A chair as in claim 1 wherein said plate means are movable with respect to said side wall members.

3. A chair as in claim 2 wherein said plate means are movable between first and second fixed positions with respect to said side wall members.

4. A chair as in claim 3 wherein said plate means include flap members hingedly attached to said plate means.

5. A chair as in claim 4 wherein said flap members are hingedly movable between first and second fixed positions.

6. A chair as in claim 5 further including a foot rest removably attached to the chair for receiving hair falling to the front of the person seated in the chair.

7. A chair as in claim 6 further including arm rests extending substantially horizontally and positioned to define slots or openings between said arm rests and said plate means, said slots being in fluid communication with said side wall cavities.

8. A chair as in claim 7 further including means in operative relationship with said plate means for guiding said plate means between said first and second positions.

9. A chair as in claim 8 wherein said guiding means define cut-out areas for facilitating movement of said plate means.

10. A chair as in claim 9 further including pivot means in operative relationship with said back rest for enabling adjustment of the degree of incline of said back rest.

11. A chair as in claim 10 wherein said back rest defines at least one chute or passageway in fluid communication with said first cavity beneath the seat member and further including a plate member movably positioned in fluid communication with said chute for receiving falling hair from the person seated in the chair and for enabling said hair to be directed to said first cavity.

12. A chair as in claim 11 wherein said plate member is movable between first and second fixed positions with respect to said back rest.

13. A chair as in claim 12 further including an additional plate member positioned within said back rest in a substantially horizontal position and in fluid communication with said chute for enabling hair to move from said additional plate member into said chute.

14. A chair as in claim 13 further including movable container means located beneath said first cavity for holding tools or similar items.

15. A chair as in claim 14 wherein said supporting means include rollers for facilitating movement of the chair.

16. A chair as in claim 14 further including means attached to said back rest for rolling up a cape to be used on the person whose hair is to be cut.

17. A chair as in claim 16 wherein said back rest defines a space for storing tools and other items.

18. A chair as in claim 17 further including arm rests positioned above said side wall members.

19. A chair as in claim 18 further including at least one lamp mounted on said back rest, said lamp being turnable in a 180° angle.

20. A chair as in claim 19 wherein said lamp includes a visible light and an infra-red light to facilitate illumination and drying of the hair of the person seated in the chair.

21. In a barberchair having a backrest and sidewalls, the improvement comprising: collecting devices connected to and in operative relationship with said backrest and sidewalls for collecting falling hair from a person seated in the chair, and wherein said collecting devices include flaps rotatably mounted to the backrest and sidewalls, and said chair further including means in operative relationship with said flaps for holding the flaps in predetermined open positions.

22. A barberchair as in claim 21 further defining collecting areas beneath said flaps for receiving hair sliding down said opened flaps from a person seated in the chair.

23. A barberchair as in claim 22 further including a foot rest defining a grill removably attached to said chair.

24. A barberchair as in claim 23 further including a cover, corresponding to said foot rest, surrounding the chair.

25. A barberchair as in claim 24 further including flexible material connecting said flaps attached to said sidewalls to said flap attached to said backrest.

26. A barberchair as in claim 21 wherein said backrest defines an interior cabinet-like space for receiving and storing tools and having an electrical outlet therein.

27. A barberchair as in claim 26 wherein said space is located above said collecting device connected to said backrest.

28. A barberchair as in claim 27 further including a swivel-mounted flap member in operative relationship with said backrest to enable selective opening and closing of said space.

29. A barberchair as in claim 28 further including a container removably positioned within at least one of said collecting areas.

30. A barberchair as in claim 21 further including a raisable and in a horizontal position arrestable additional flap located on an upper rim of said backrest and extending across the rim, and wherein the backrest defines a hollow space.

31. A barberchair as in claim 30 further including a chute-like slide connecting together in fluid communicating relationship said backrest space and said collecting areas.

32. A barberchair as in claim 31 further including a swivel-mounted flap member attached to an upper rim of said backrest hollow space, whereby said swivel-mounted flap member can be swung in a vertical and into a horizontal position and whereby one position will basically cover an opening of said backrest hollow space and the other position will cause said swivel-mounted flap member to protrude like a table beyond the outer perimeter of the chair.

33. A barberchair as in claim 32 wherein said sidewalls include armrests defining connecting receptacles to the side of the armrests.

34. A barberchair as in claim 33 further including a bowl-like receptacle located at the lower end of said collecting devices.

35. A barberchair as in claim 34 wherein said collecting devices include a swivel-mounted flap placed above an outer rim of the collecting container, and said swivel-mounted flap can be swung into a vertical and horizontal position, whereby said flap covers in one position basically cover the collecting container and in the other the flap extends like a table beyond the outer rim of the container.

36. A barberchair as in claim 21 further including a coiling device and a cape rolled up by said device, said device and said cape located in an upper portion of said backrest.

* * * * *

UNITED STATES PATENT AND TRADEMARK OFFICE

CERTIFICATE OF CORRECTION

PATENT NO. : 4,136,907

DATED : January 30, 1979

INVENTOR(S) : Margret Hermanns

It is certified that error appears in the above-identified patent and that said Letters Patent are hereby corrected as shown below:

claim 29, line 1, change the numeral "28" to the numeral --25--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*